US006414449B1

(12) United States Patent
Hui et al.

(10) Patent No.: US 6,414,449 B1
(45) Date of Patent: Jul. 2, 2002

(54) UNIVERSAL ELECTRONIC BALLAST

(75) Inventors: Ron Shu Yuen Hui, New Territories; Leung Ming Lee, Kowloon, both of (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 09/718,459

(22) Filed: Nov. 22, 2000

(51) Int. Cl.[7] ..... G05F 1/00

(52) U.S. Cl. ..... 315/291; 315/224; 315/307; 315/209 R; 315/DIG. 7

(58) Field of Search ..... 315/307, 291, 315/224, 209 R, 244, 219, DIG. 7

(56) References Cited

U.S. PATENT DOCUMENTS 4,928,038 A * 5/1990 Nerone ..... 315/209 R
5,345,148 A * 9/1994 Zeng et al. ..... 315/209 R
6,008,593 A * 12/1999 Ribarich ..... 315/307
6,031,342 A * 2/2000 Ribarich et al. ..... 315/291
6,181,079 B1 * 1/2001 Chang et al. ..... 315/247

OTHER PUBLICATIONS

Zhu et al., "Modelling of a high–frequency operated fluorescent lamp in an electronic ballast environment," *IEE Proc.–Sci. Meas. Technol.*, vol. 145, No. 3, pp. 111–116 (May 1998).

* cited by examiner

*Primary Examiner*—Haissa Philogene
(74) *Attorney, Agent, or Firm*—Merchant & Gould P.C.

(57) ABSTRACT

An electronic ballast is disclosed that is capable of operating with any fluorescent lamp within a range of nominal operating powers. The electronic ballast is capable of sensing the power rating of the lamp from the peak lamp voltage, and provides for varying the switching frequency of the ballast depending on the power rating of the lamp.

15 Claims, 8 Drawing Sheets

UNIVERSAL ELECTRONIC BALLAST

FIELD OF THE INVENTION

This invention relates to an electronic ballast for a fluorescent lamp, and in particular to such a ballast that is capable of operating with a range of fluorescent lamps of different power ratings.

BACKGROUND TO THE INVENTION

Fluorescent lamps are driven by an electronic ballast. Conventional ballasts are, however, normally designed for use with a fluorescent lamp of a particular power rating (which may in a commercial or industrial fluorescent lamp typically be in the range of 18 W to 70 W) and ballast manufacturers usually offer a range of ballasts adapted for use with differently powered lamps.

A conventional form of electronic ballast is the half-bridge inverter type shown in FIG. 1. This form of ballast comprises a resonant tank formed by a resonant inductor $L_r$ and a resonant capacitor $C_r$. The resonant capacitor is connected across the lamp and the two switches S1 and S2 are switched on and off alternately at high frequency (typically between 20 kHz and 70 kHz) so that a high frequency ac voltage $V_{xy}$ can be created across the resonant circuit. Before the lamp's arc is struck, the lamp impedance is very high (and is almost an open circuit). The voltage across the capacitor can be very high (and resonance and this high capacitor voltage can cause the arc of the lamp to strike. Once the lamp is on, the impedance drops and the resonant inductor functions to limit the current flowing through the lamp.

By controlling the switching frequency of S1 and S2, the frequency of $V_{xy}$, which is also the operating frequency of the lamp, can be controlled. In particular, by increasing the switching frequency the impedance of the resonant inductor is also increased and this functions to reduce the power of the lamp.

SUMMARY OF THE INVENTION

According to the present invention there is provided an electronic ballast system capable of driving a fluorescent lamp within a range of nominal power ratings, comprising: means for varying the switching frequency of an electronic ballast over a range including at the bottom end of the range the switching frequency necessary for a lamp at the upper limit of said range of power ratings.

By means of this arrangement, a single electronic ballast may be provided that is capable of driving any fluorescent lamp within a range of nominal power ratings.

In a preferred embodiment the electronic ballast system comprises means for sensing the power rating of the lamp, and means for selecting a corresponding switching frequency. Preferably the sensing means comprises means for sensing the peak lamp voltage.

In a preferred embodiment the means for varying the switching frequency of said ballast comprises a voltage controlled oscillator, and the means for selecting a corresponding switching frequency comprises means for generating an input signal to said voltage controlled oscillator. The means for generating an input signal may comprise means for providing a compensated inverted peak lamp voltage and means for mapping the compensated peak lamp voltage to an input signal for said voltage controlled oscillator.

In a particularly preferred arrangement the electronic ballast system may comprise initial ignition control means that controls the switching frequency of the ballast to provide an arc-striking switching frequency selected such that it will ignite any lamp within the range of nominal power ratings. Preferably, also, means are provided to supply to said lamp a warm-up current before said lamp is ignited.

Another preferred aspect of the present invention is that it may comprise means for sensing lamp failure, and this means may comprise means for detecting when the peak voltage of said lamp remains high for a continuous period.

Viewed from another broad aspect the present invention provides a method of driving a fluorescent lamp within a range of nominal power ratings, comprising: (a) providing an electronic ballast capable of operating at a range of switching frequencies including at the bottom end of the range the switching frequency necessary for a lamp at the upper limit of said power range, (b) identifying the nominal power rating of a said lamp to be driven, and (c) selecting an appropriate switching frequency for the said lamp.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENT

Figure 1:
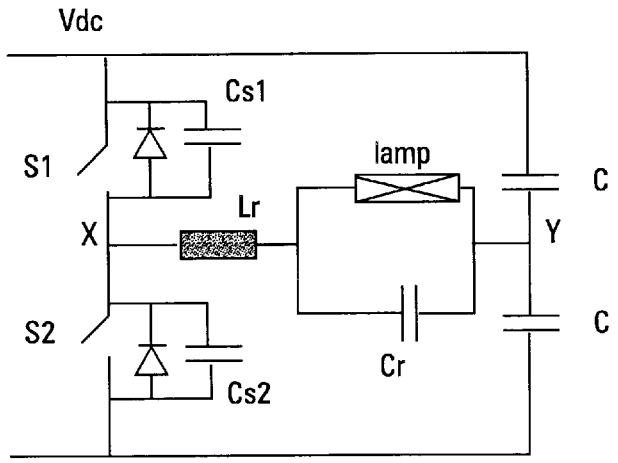
Fig. 1 Prior Art
FIG. 1 is a schematic diagram of an electronic ballast in the form of a half-bridge inverter.

Referring once again to FIG. 1, a preferred embodiment of the present invention provides an electronic ballast of the half bridge inverter type shown in FIG. 1 that is capable of operating with fluorescent lamps of a range of nominal power ratings, typically 18 W to 70 W. To allow the ballast of FIG. 1 to be able to function with a range of lamps of varying power ratings, the ballast must firstly be designed to work with a lamp of the highest power within the range and the resonant inductor $L_r$ and the resonant capacitor $C_r$ forming the resonant tank must be selected accordingly. If the maximum power rating within the desired range is 70 W, then the ballast must be designed to work with a 70 W lamp.

For example, using the fluorescent lamp modelling techniques developed in Zhu Peiyuan & Hui S Y R, *'Modelling of a high-frequency lamp in an electronic ballast environment' IEEE Proceedings Part-A*, Vol. 145, No. 3, May 1998, pp111–116 it can be calculated that for a 70 W lamp the resonant inductor $L_r$ should be about 1.6 mH and the resonant capacitor $C_r$ should be about 24.2 nF with a switching frequency of 25.5 kHz and a DC inverter voltage $V_{DC}$ of 300 V. Therefore in a preferred embodiment of the invention, the half-bridge inverter ballast is designed with these parameters.

With a ballast having these values for the resonant inductor, the resonant capacitor, and the DC inverter voltage, it is also possible to calculate the lamp power of other lamps with other power ratings as a function of the switching frequency. This is shown in FIG. 2 which plots the relevant curves for five lamps having normal power ratings of 18 W, 30 W, 36 W, 58 W and 70 W respectively.

Figure 2:
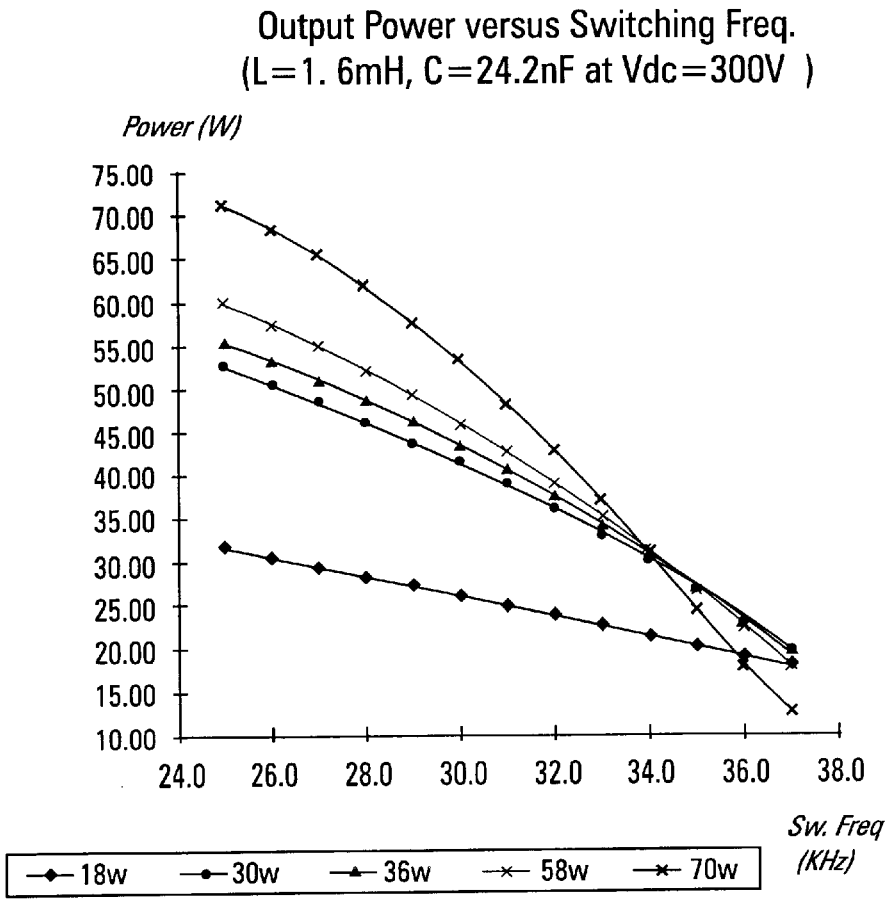
FIG. 2 is a plot showing theoretical lamp power against switching frequency.
Figure 3:
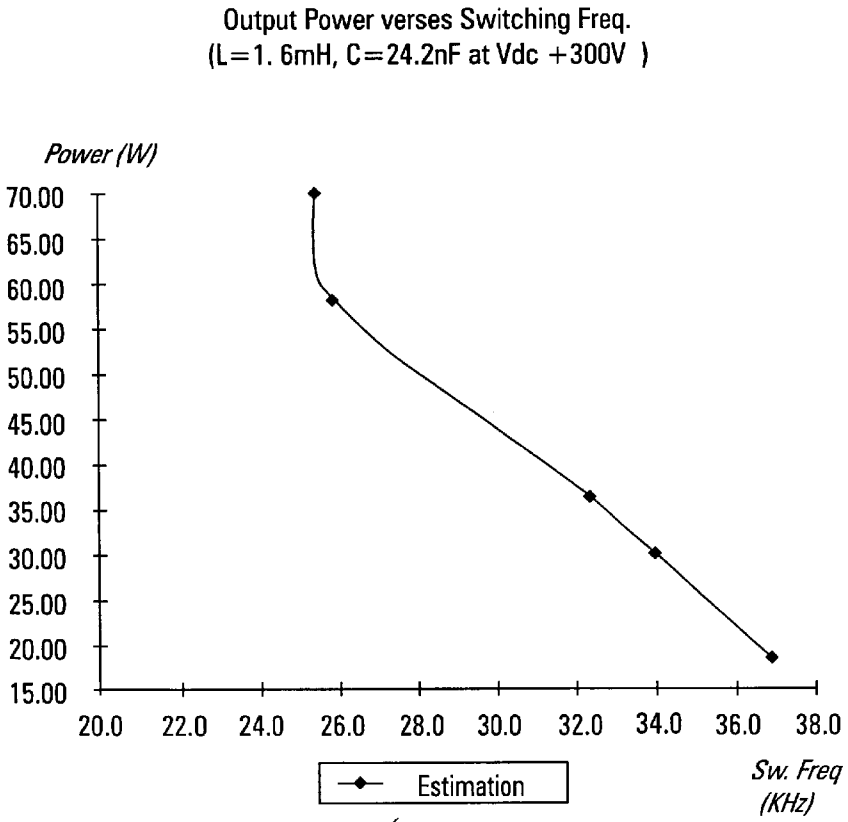
FIG. 3 is a plot showing proposed switching frequencies for desired output lamp powers.

It will be noted in FIG. 2 that for each curve the lamp power falls with increasing switching frequency. It is therefore possible to find a switching frequency at which the lamp power is equal to the normal operating power. From FIG. 2 it can be seen that for an 18 W lamp the switching frequency should be about 36.9 kHz, for a 30 W lamp the switching frequency should be about 34 kHz, for a 36 W lamp the switching frequency should be about 32.4 kHz, and for a 58 W lamp the switching frequency should be about 26 kHz. These values are plotted in FIG. 3 which plots normal operating power against switching frequency.

It will be appreciated that a ballast that is designed to operate with a lamp of the highest power rating of the range, can therefore also be used with lamps of lower power rating provided that the switching frequency of the ballast is increased. It is necessary, however, for the power rating of the lamp to be known in order that the switching frequency may be set accordingly.

In one possible embodiment, the power rating of a fluorescent lamp may simply be known by a user who may then make an appropriate adjustment to the switching frequency. This is troublesome, however, and is open to human error. More preferably the ballast may be provided with means for automatically identifying the power rating of any lamp to which the ballast is attached and for appropriately setting the switching frequency.

In a preferred embodiment of the invention the electronic ballast control circuit may be designed to determine the type of lamp and to automatically choose the appropriate switching frequency. In this embodiment, the method of detecting the lamp power rating takes advantage of the on-state lamp voltage (ie the voltage across the two ends of the lamp) since the lamp voltage is generally proportional to the length and power of the lamp. The lamp voltage is generally sinusoidal and typical peak voltages for various known commercial lamps are as follows:

| Lamp type | Peak lamp voltage |
|---|---|
| Philips TLD18W/33 | 78 V |
| Philips TLD30W/33 | 140 V |
| Philips TLD36W/33 | 154 V |
| Philips TLD58W/33 | 176 V |
| Philips TLD70W/33 | 222 V |

This peak lamp voltage may be sensed and then, after stepping down, may be applied to the control circuitry to appropriately adjust the switching frequency.

Figure 4:
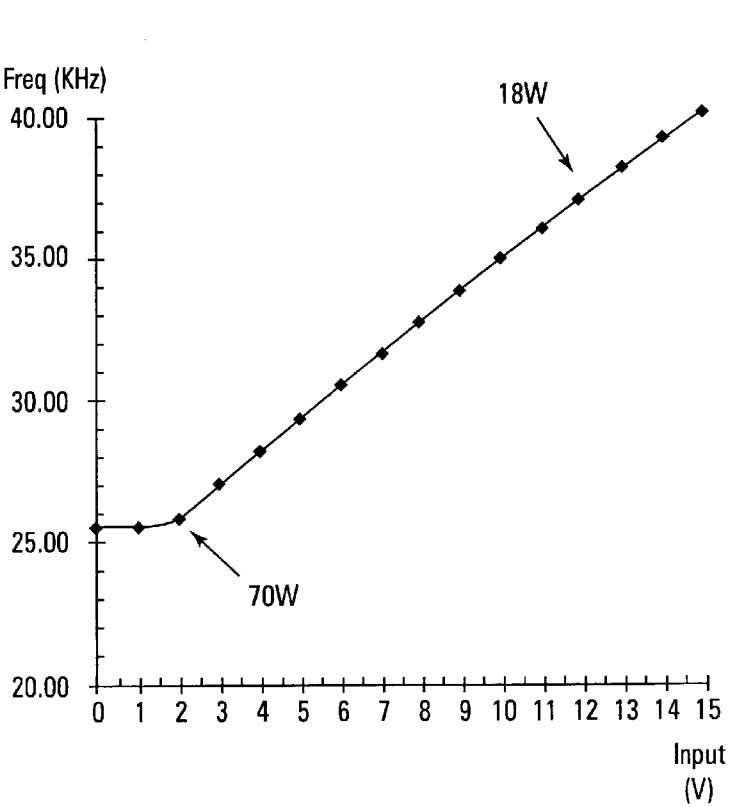
FIG. 4 is a plot showing the variation of a voltage controlled oscillator with input control voltage.

In this embodiment of the invention a voltage control oscillator (VCO) is used to control the switching frequency of S1 and S2 such that the input voltage to the VCO is proportional to the switching frequency, as is shown in FIG. 4. Since the desired switching frequency decreases with increasing lamp power, and since peak lamp voltage increases with lamp power, a mapping function is required to map a peak lamp voltage to an input voltage to the VCO, and hence to the switching frequency. It is also preferable that a minimum switching frequency be set so that the ballast will not operate with a lamp of a power rating higher than the maximum power rating within the predetermined range.

To achieve the desired mapping function a compensated peak lamp voltage is derived from the peak lamp voltage. The compensated peak lamp voltage decreases as the peak lamp voltage increases. If a DC voltage of $V_{cc}$ is used in the electronic control circuit, the compensated peak voltage $V_{CPV}$ can be derived as:

$$V_{CPV}=V_{cc}-(V_{lamp\text{-}peak})/k$$

Where $V_{lamp\text{-}peak}$ is the actual peak lamp voltage. In the present embodiment of the invention $V_{cc}$=15 V and k=15.625

Figure 5:
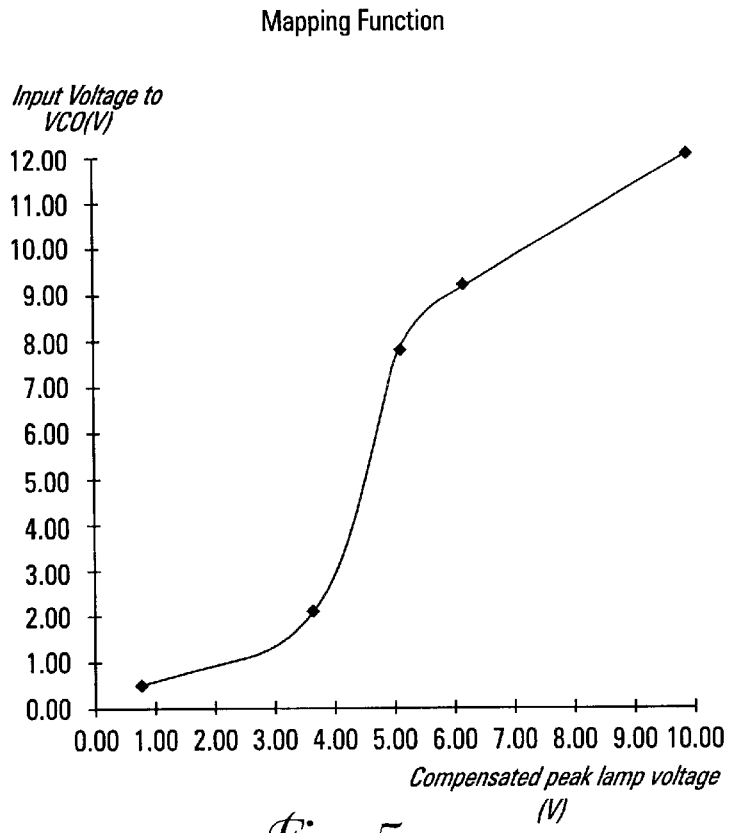
FIG. 5 is a plot showing a mapping function between a VCO input voltage and a compensated peak lamp voltage.

Thus as the power of the lamp increases and the actual peak voltage increases, the compensated lamp voltage will decreases and thus the compensated lamp voltage can be used to map to an input voltage for the VCO such that a required switching frequency is obtained. FIG. 5 shows an appropriate mapping.

For certain types of fluorescent lamp a warm-up period (for example about 0.5 s) before the arc is struck may be either necessary or preferable in order to maximise the operating life of the lamp. To enable such a warm-up period with a ballast according to an embodiment of the present invention, the automatic detection mechanism can be disabled for a short period and the switching frequency can be arbitrarily set at a frequency higher than the maximum value of the normal frequency range for all types of lamps concerned. This ensures that the switching frequency is far from the resonant frequency of the electronic ballast circuit so that the voltage across the resonant capacitor is not high enough to cause the lamp arc to strike. At a frequency higher than the resonant frequency of the ballast circuit, the voltage across the lamp is relatively low when compared with the voltage at the resonant frequency and this low voltage allows a small current to warm up the filament. After this warm-up period, the normal operation of the ballast of the invention may be engaged as described previously so as to cause the lamp arc to strike.

The lamp-type detection mechanism as described above will not operate until the lamp is actually switched on. It is therefore necessary to choose a switching frequency that will cause the lamp to strike before the lamp type detection mechanism can function to detect the lamp type and to select an appropriate switching frequency. Preferably therefore an initial switching frequency is set that will enable all lamps within the desired power range to strike and to turn on. It is preferable therefore to select an appropriate arc-striking frequency. In a preferred embodiment of the invention a switching frequency is chosen that will cause all the lamps within the desired range to strike and to operate not too far from their theoretical power rating.

Table 3 shows the actual powers for a range of lamps (18 W, 30 W, 36 W, 58 W, 70 W) at different switching frequencies with a DC input voltage of 300 V.

TABLE 3

| Switching Frequency | 18W | 30W | 36W | 58W | 70W |
|---|---|---|---|---|---|
| 25.0 | 31.93 | 53.00 | 55.70 | 60.02 | 71.34 |
| 26.0 | 30.70 | 50.98 | 53.58 | 57.74 | 68.64 |
| 27.0 | 29.51 | 48.86 | 51.32 | 55.25 | 65.52 |
| 28.0 | 28.35 | 46.61 | 48.90 | 52.55 | 61.97 |
| 29.0 | Z7.20 | 44.24 | 46.34 | 49.64 | 57.96 |
| 30.0 | 26.06 | 41.72 | 43.57 | 46.44 | 53.47 |
| 31.0 | 24.93 | 39.02 | 40.60 | 43.02 | 48.54 |
| 32.0 | 23.80 | 36.20 | 37.48 | 39.34 | 43.09 |
| 33.0 | 22.65 | 33.17 | 34.09 | 35.36 | 37.27 |
| 34.0 | 21.48 | 29.98 | 30.57 | 31.21 | 30.98 |
| 35.0 | 20.31 | 26.67 | 26.81 | 26.70 | 24.45 |
| 36.0 | 19.12 | 23.11 | 22.89 | 22.18 | 17.99 |
| 37.0 | 17.88 | 19.56 | 18.90 | 17.34 | 12.22 |

While the selection of the arc-striking frequency will always involve a degree of compromise, a switching frequency of 31.0 kHz may be chosen as the arc-striking frequency as at this frequency all the lamps are reasonable close to their normal rated values, and even where a lamp may be at a higher power than its rated value (eg the 18 W lamp is at 24.93 W) the lamp power will not be excessive because operation usually takes several minutes to reach steady state and the initial lamp voltage is usually less than the steady state voltage so the actual lamp power is lower.

A further advantage of the present invention is that the sensing of the peak lamp voltage can be used to detect lamp failure. If the filament of the lamp is burnt out or broken and there is no conduction in the lamp, the lamp will behave like an open circuit and the voltage across the lamp is continuously high. This continuous high voltage condition may be detected as an indication of lamp failure.

Figure 7:
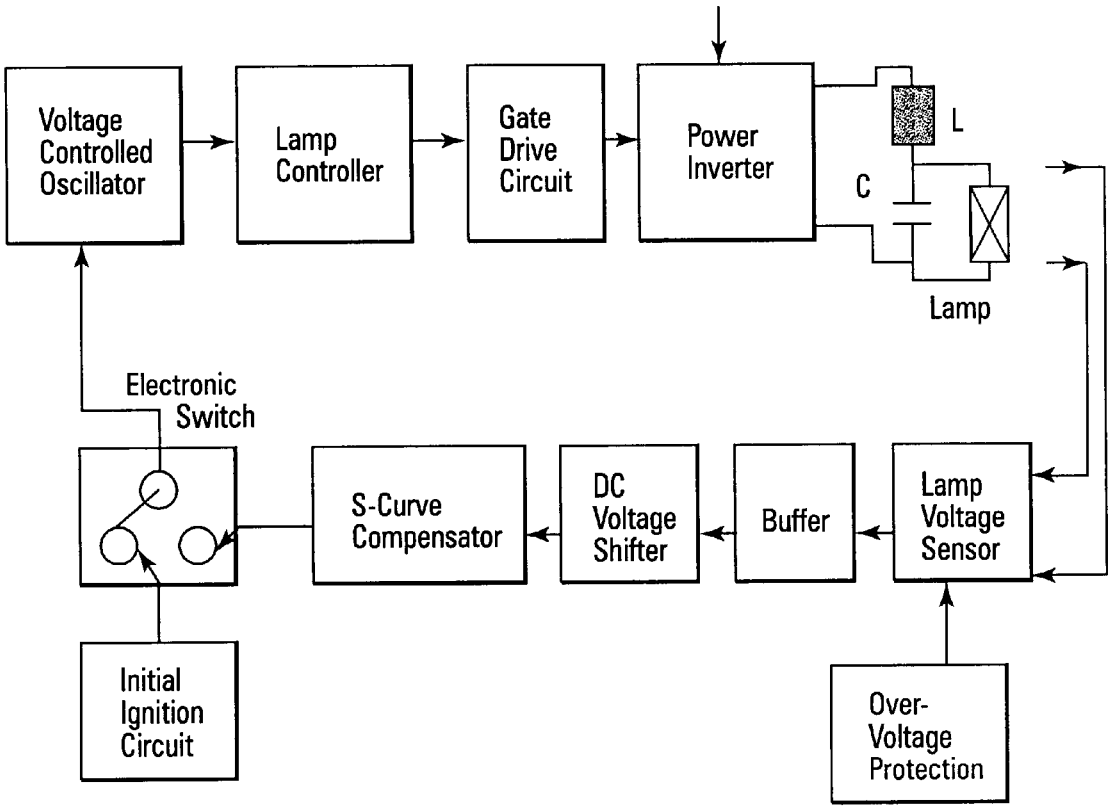
FIG. 7 is a functional schematic diagram showing one possible embodiment of the invention.

FIG. 7 is a functional block diagram of an electronic ballast according to a first embodiment of the invention. This embodiment of the invention is a closed loop control system and the sensed peak output lamp voltage is fed back to the input of the lamp controller through the feedback network. The operation of this embodiment of the invention will be described as follows.

To begin with the electronic switch 1 is connected to the initial ignition circuit 2 for about 1 second. The initial ignition circuit 2 provides a pre-set arc-striking frequency signal to the voltage controlled oscillator 3 which then generates the starting frequency for the lamp controller 4 and the gate drives 5 which control the switching frequency of the power inverter 6 to provide an initial start-up arc-striking frequency (say 31 kHz). Before the lamp is turned on, the voltage across the lamp is high (about 1 kV) and therefore an over-voltage protection circuit 7 is used to clamp the voltage of the scaled down peak lamp voltage so that the output of the lamp voltage sensor 8 is not too high. This one second period is normally sufficient to warm the filaments and start the lamp.

After ignition, the electronic switch 1 is connected to the output of the S-curve compensator 9. Once the lamp is ignited, the lamp voltage will drop rapidly. As is explained above, however, the peak lamp voltage rises with lamp power and therefore a higher sensed peak lamp voltage means that the lamp is of a higher power rating an a lower switching frequency is required. However, the output of the voltage controlled oscillator 3 increases linearly with the input voltage, and therefore the sensed peak output voltage cannot be input directly to the VCO 3 but must first be inverted so that a higher sensed peak lamp voltage produces a lower input to the VCO 3. This is achieved by providing a compensated peak lamp voltage and a S-curve compensator 9 as described above.

Figure 6:
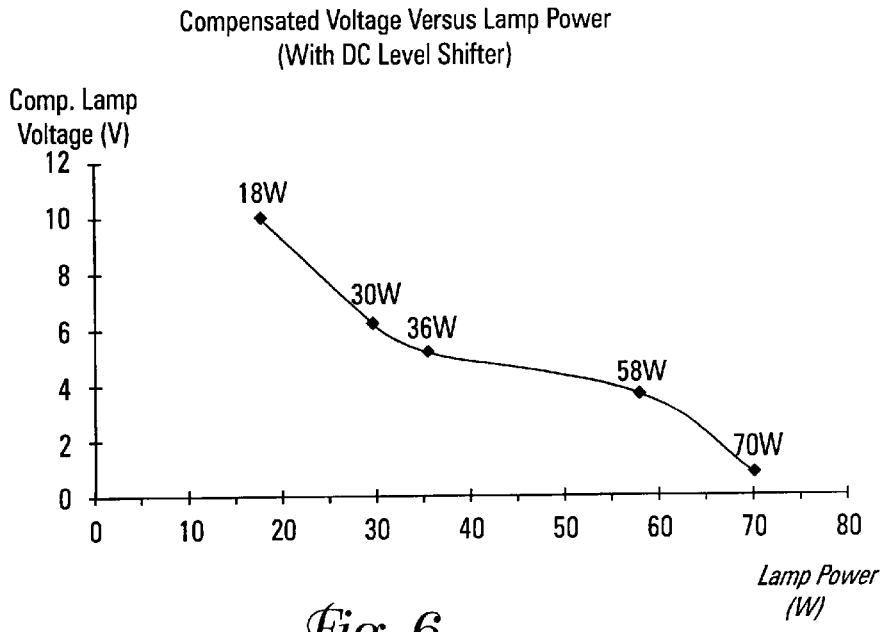
FIG. 6 is a plot showing the relationship between compensated peak lamp voltage and lamp power.

FIG. 6 plots the compensated lamp voltage against power. It should be noted, however, that the compensated lamp voltage cannot be input directly to the VCO 3. This can be seen for example from a consideration of a 18 W lamp. The compensated lamp voltage is 10 V but if this were input to the VCO 3 a switching frequency of 35 kHz would be output whereas the correct switching frequency for a 18 W lamp is 37 kHz. This discrepancy is because the relationship between the actual lamp power and the lamp voltage is non-linear, whereas there is a linear relationship between the input and output of the VCO 3. The S-curve compensator 9 provides a necessary mapping function as described with reference to FIG. 5.

The lamp controller is used to convert the signal output from the VCO 3 to inverted or non-inverted signals for the isolated gate drive circuits of the power switches. The lamp controller also provides a dead time between the gating signals of the two power switches so as to avoid short-circuit situations in the power inverter.

The voltage controlled oscillator 3 may be a conventional phase-locked loop device. The linear VCO 3 produces an output signal the frequency of which is dependent on the input voltage.

Figure 8:
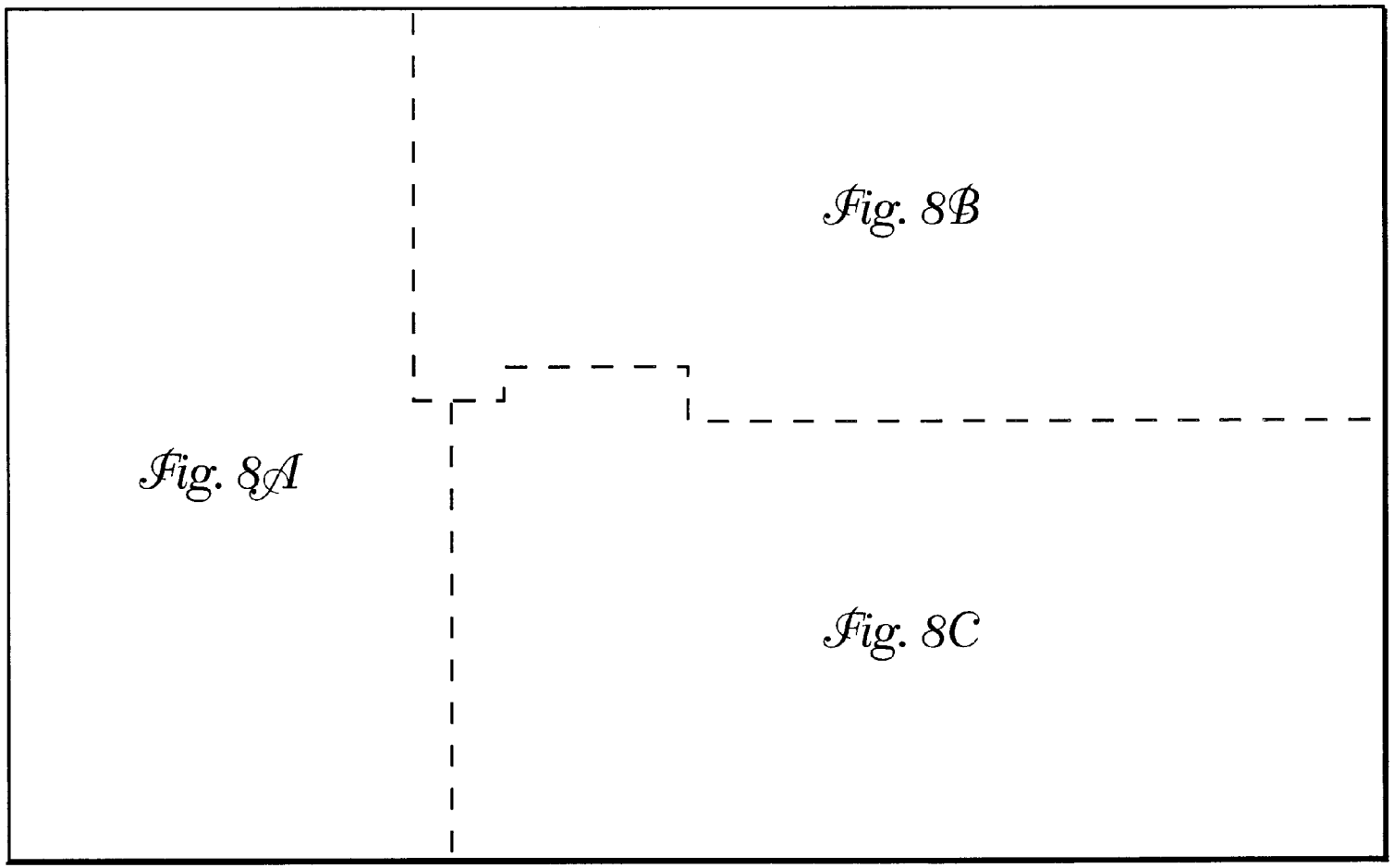
FIG. 8 is a schematic representation of the division of a circuit diagram showing one possible realization of the embodiment of FIG. 7, represented as FIGS. 8A–8C.
Figure 8A:
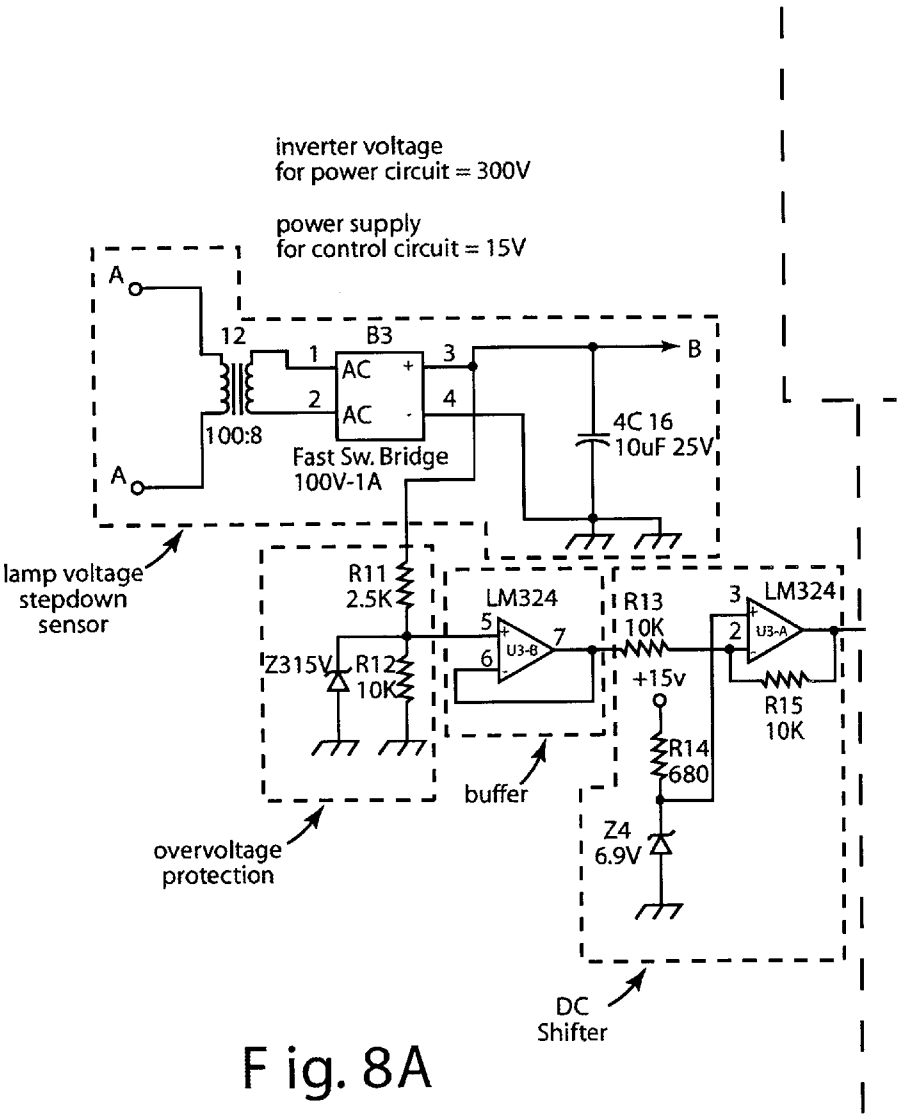
FIG. 8A is a partial view of FIG. 8.
Figure 8B:
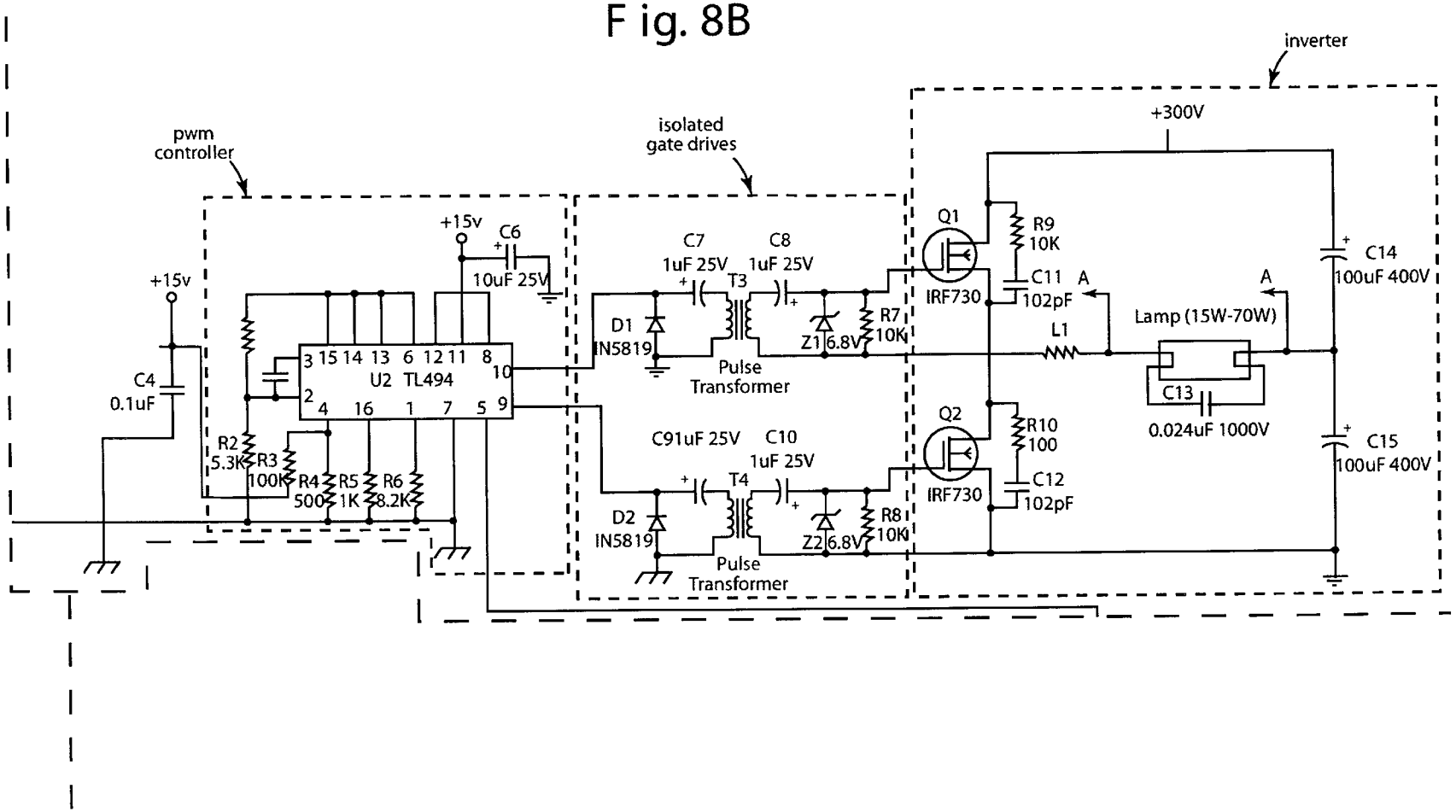
FIG. 8B is a partial view of FIG. 8.
Figure 8C:
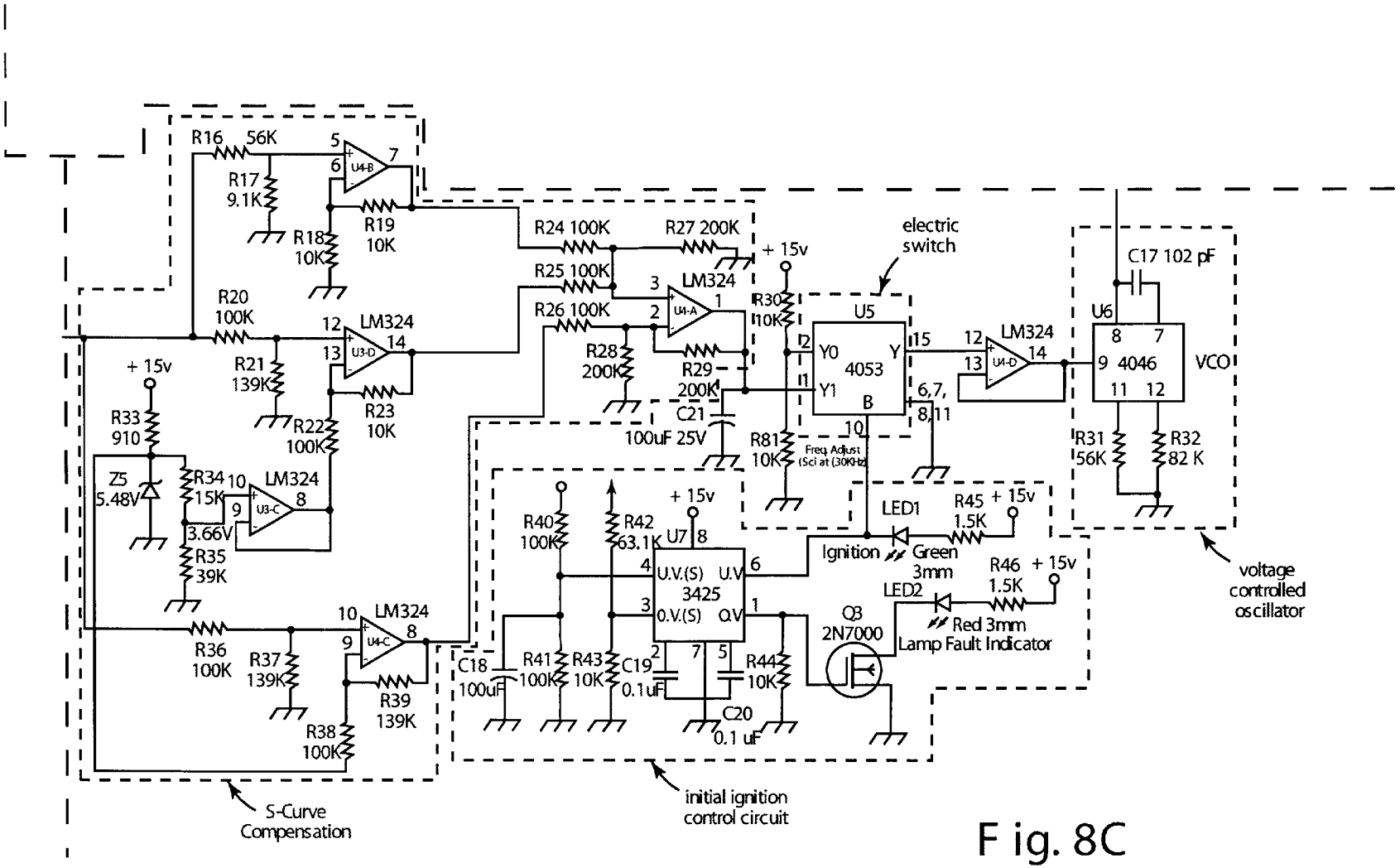
FIG. 8C is a partial view of FIG. 8.

FIG. 8 is a circuit diagram showing one possible manner of implementing the embodiment of FIG. 7.

What is claimed is:

1. An electronic ballast system capable of driving a fluorescent lamp within a range of nominal power ratings, comprising:

means for varying the switching frequency of an electronic ballast over a range including at the bottom end of the range the switching frequency necessary for a lamp at the upper limit of said range of power ratings;

means for sensing the power rating of the lamp; and means for selecting a corresponding switching frequency.

2. An electronic ballast system as claimed in claim 1, wherein said sensing means comprises means for sensing a peak lamp voltage.

3. An electronic ballast system as claimed in claim 2 wherein said means for varying the switching frequency of said ballast comprises a voltage controlled oscillator, and wherein said means for selecting a corresponding switching frequency comprises means for generating an input signal to said voltage controlled oscillator.

4. An electronic ballast system as claimed in claim 3 wherein said means for generating an input signal comprises means for providing a compensated inverted peak lamp voltage and means for mapping said compensated peak lamp voltage to an input signal for said voltage controlled oscillator.

5. An electronic ballast system as claimed in claim 1 comprising initial ignition control means that controls the switching frequency of said ballast to provide an arc-striking switching frequency selected such that it will ignite any lamp within said range of nominal power ratings.

6. An electronic ballast system as claimed in claim 1 wherein means are provided to supply to said lamp a warm-up current before said lamp is ignited.

7. An electronic ballast system as claimed in claim 1 comprising means for sensing lamp failure.

8. An electronic ballast system as claimed in claim 7 wherein said lamp failure sensing means comprises means for detecting when the peak voltage of said lamp remains high for a continuous period.

9. A method of driving a fluorescent lamp within a range of nominal power ratings, comprising:

(a) providing an electronic ballast capable of operating at a range of switching frequencies including at the bottom end of the range the switching frequency necessary for a lamp at the upper limit of said power range, (b) identifying the nominal power rating of said lamp to be driven, and (c) selecting an appropriate switching frequency for said lamp.

10. A method as claimed in claim 9 wherein the power rating of said lamp is identified automatically.

11. A method as claimed in claim 10 including the power rating of the lamp by sensing the peak lamp voltage of said lamp.

12. A method as claimed in claim 11 comprising the steps of: varying the switching frequency of said ballast by means of a voltage controlled oscillator, and wherein a corresponding switching frequency is selected by of generating an input signal to said voltage controlled oscillator.

13. A method as claimed in claim 12 wherein said input signal is generated by providing a compensated inverted peak lamp voltage and mapping said compensated peak lamp voltage to said input signal for said voltage control oscillator.

14. A method as claimed in claim 9 further comprising providing an initial ignition arc-striking switching frequency signal to said ballast.

15. A method as claimed in claim 9 further comprising a warm-up current to said lamp before ignition.

* * * * *